US005870772A

United States Patent [19]

Sprouse

[11] Patent Number: 5,870,772

[45] Date of Patent: Feb. 16, 1999

[54] FLEXIBLE TRACKING ASSEMBLY FOR A SPORTS CAP HAVING A ROTATABLE VISOR OR THE LIKE

[76] Inventor: Charles B. Sprouse, 12015 Rocksprings Dr., Louisville, Ky. 40245

[21] Appl. No.: 845,232

[22] Filed: Apr. 21, 1997

[51] Int. Cl.[6] ..... A42B 1/06

[52] U.S. Cl. ..... 2/10; 2/195.1

[58] Field of Search ..... 2/10, 195.1, 209.13, 2/181; 24/587

[56] References Cited

U.S. PATENT DOCUMENTS

| | | | |
|---|---|---|---|
| 1,232,992 | 7/1917 | Stering . | |
| 4,989,270 | 2/1991 | Boughten | 2/171.7 |
| 5,070,545 | 12/1991 | Tapia | 2/195 |
| 5,359,733 | 11/1994 | Brannon et al. | 2/195.1 |
| 5,373,586 | 12/1994 | Brosnan | 2/195.1 |
| 5,437,062 | 8/1995 | Douglas | 2/195.1 |
| 5,471,684 | 12/1995 | Casale | 2/195.1 |
| 5,533,211 | 7/1996 | Mehrens | 2/182.1 |
| 5,715,534 | 2/1998 | Mobley | 2/10 |

*Primary Examiner*—Diana L. Biefeld
*Attorney, Agent, or Firm*—Dougherty & Troxell

[57] ABSTRACT

A sports cap is constructed from a plurality of pie-shaped pieces of fabric that are sewn together at a plurality of seams to form a crown or hat portion. The sports cap also includes a relatively stiff removable and rotatable visor so that the visor can be rotated from front to back or to either side while the crown remains stationary on the head of an individual. An elongated member which has a C-shaped cross section is stitched to a rear portion of the visor and is constructed and arranged to engage an elongated track member. The elongated track member has an I-shaped cross section which extends around the circumference of the crown at the base thereof and which is stitched to the base. The I-shaped cross section is constructed and arranged to fit within a channel which is defined by the C-shaped cross section of the elongated member so that the visor may be removed therefrom or rotated thereabout. A flexible tracking assembly for use with a sports cap or for other applications will also include a first elongated member with opposed edges and an intermediate portion which extends along a first article and a second I-shaped track member fixed there to. A third elongated plastic member is superposed on the first and second member and extends over the second member and together with the first or second member defines an opening along one side thereof. A C-shaped element which is connected to a second article is then disposed in sliding engagement with the track member.

7 Claims, 4 Drawing Sheets

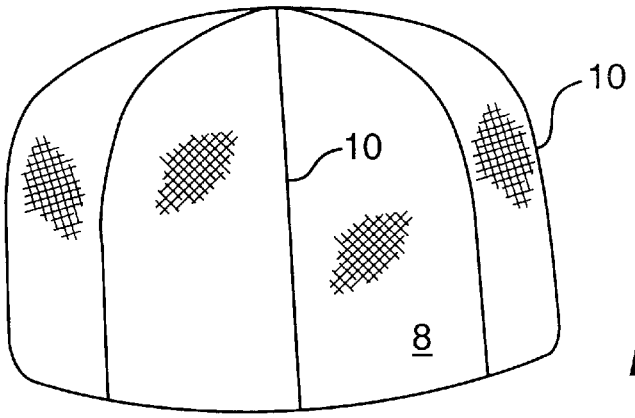
FIG. 3
FIG. 4-1
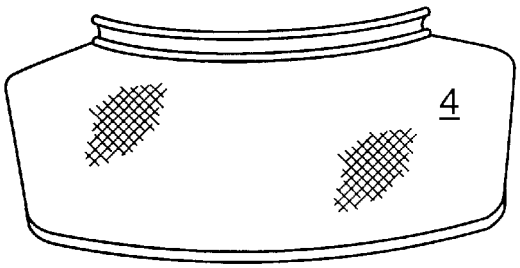
FIG. 4-2
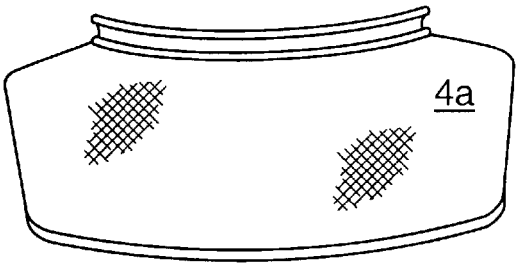
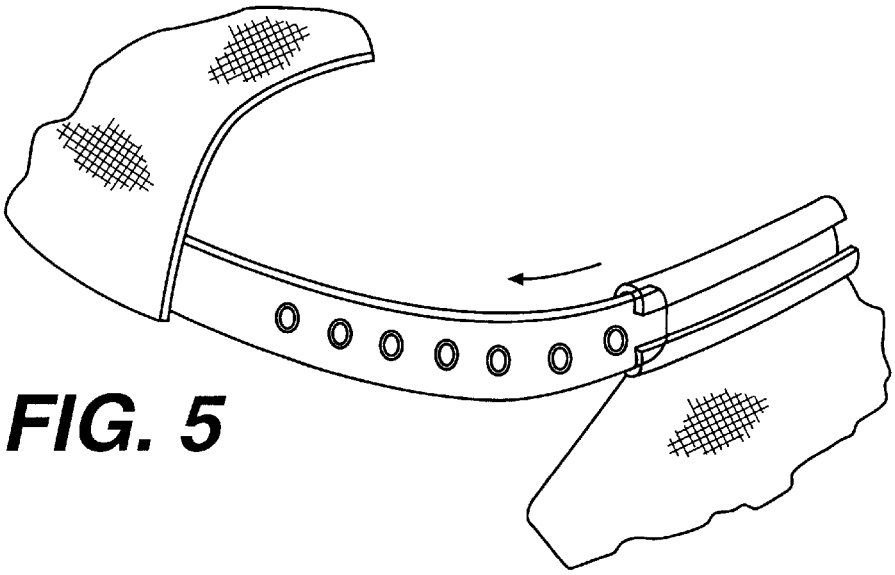
FIG. 5

FLEXIBLE TRACKING ASSEMBLY FOR A SPORTS CAP HAVING A ROTATABLE VISOR OR THE LIKE

FIELD OF THE INVENTION

This invention relates to a flexible tracking device to be used in various applications including a sports cap having a rotatable and removable visor and more particularly to a tracking assembly for such sports caps or the like.

BACKGROUND FOR THE INVENTION

Sports caps with replaceable front logos are disclosed in the U.S. Patents of Brannon et al., U.S. Pat. No. 5,359,733 and Brosnan, U.S. Pat. No. 5,373,586. Such caps include a replaceable trade name or logo which is typically affixed to the front of the crown portion of the cap so that the cap can be worn on different occasions. As disclosed in the Brannon et al. patent, an individual selects one of several team logos, phrases, names or special events shown on a display panel or patch and attaches that panel or patch to the front of the cap. The selected panel or patch then gives the appearance of being permanently sewn to the hat.

Removable and replaceable visors for baseball caps and the like are also known. For example, the Tapia, U.S. Pat. No. 5,070,545 discloses an adjustable baseball cap having a crown portion and an interchangeable visor. As disclosed therein, a visor includes an eye shade portion and an upstanding arc-shaped portion with a plurality of engagement members such as Velcro fasteners or snap fasteners so that visors of different color or shape are interchangeable.

It is now believed that there may be a significant commercial market for an improved baseball cap or the like wherein the visor may be readily replaced with a visor of a different shape or color and also rotated about the crown. Rotating the visor from one side to another allows an individual to shield their eyes from the sun and at the same time allows the team logo or other indicia to remain in a central position. Accordingly, the present invention contemplates a flexible tracking system which allows a sports cap or the like to have a rotatable and replaceable visor.

A sports cap in accordance with the present invention advantageously includes a visor which can be rotated 360° about the crown and readily removed therefrom. Therefore, the team logo faces forward even when the visor or sun shield is worn at the rear in a manner which simulates that of a baseball catcher. In addition, the visor may be readily "snapped-off" and replaced by a visor of a different color or shape. The sports caps in accordance with the present invention are also relatively inexpensive to manufacture, light in weight, durable and make it relatively easy to change visors. For example, the visor or a different visor may be readily attached to and removed from the tracking device by threading off and on at the rear of the cap. Also, the rotatable and removable structure can be ready combined with an adjustment member so that the cap can be worn by individuals with different head sizes.

It is also believed that the tracking assembly which is disclosed herein may have a number of other applications such as a removable cover for the bed of a pickup truck, a canvas cover for boats and/or open top trailers, drapery installations, rotatable belts, etc.

BRIEF SUMMARY OF THE INVENTION

In essence, the present invention contemplates a flexible tracking device for a baseball cap or the like which has a removable and rotatable visor. The tracking device or assembly may also be used for other applications such as drapes, truck covers, etc. As disclosed herein, the cap includes a crown or hat portion which is preferably constructed from a plurality of pie-shaped pieces of fabric that are sewn together at a plurality of seams in a customary manner. The hat portion has a lower substantially circular periphery or base which defines the circumference of the hat portion. The cap also includes means for releasable holding the visor in sliding engagement with the hat portion so that the visor can be rotated about the cap while any logo applied to a front or other portion of the hat portion remains in its original position as, for example, on the front of the cap. The tracking assembly is designed to minimize the likelihood of a sliding element binding with a cloth portion of a cap as it slides along the track. The means for releasable holding the visor to the cap also allows the visor to be removed and replaced by a visor of a different color, shape or by one bearing a different logo.

In a preferred embodiment of the invention, a baseball cap or the like has a removable and rotatable visor. The cap includes a hat portion which is constructed from a plurality of pie-shaped pieces of fabric that are sewn together at a plurality of seams in a customary manner. The hat portion has a lower substantially circular periphery or base which defines the circumference of the hat portion. In the preferred embodiment of the invention the fabric at the base of the cap is folded under, i.e., inwardly to form a double thickness of material around the base. A first semi-rigid elongated extending plastic member having opposite edges i.e., top and bottom edges and an intermediate portion therebetween is fixed to and extends substantially around the periphery of the hat circumference. A second generally I-shaped elongated plastic track member having top and bottom edges and a central area between the top and bottom edges is superimposed and fixed to the first elongated member through the intermediate portion and central area as for example by stitching. A third elongated plastic member having opposite edges and an intermediate portion is preferably about the same size and shape as the first elongated member and is superposed thereon with the second I-shape elongated plastic track member therebetween. The third elongated member is fixed to the first elongated member along or near one edge thereof. A C-shape element which may be elongated is fixed to a visor or the like. The C-shaped element may be elongated and generally conformed to the arc-shaped rear portion of the visor and extends upwardly therefrom. The C-shape element which may be elongated and arc-shaped is stitched or stapled to the arc-shaped portion of the visor so that the radius of the arc-shaped visor and the radius of the semi-rigid member are essentially equal. The C-shaped element which may be arc-shaped or in the form of a plurality of C-shape elements disposed along the arc slidably engage the second generally I-shaped elongated track member which is also arc-shaped as it runs around the circumference or base of the hat. Therefore, the C-shaped element or elements is rotatable along the track member about the circumference of the hat portion so that the visor can rotate around the hat portion. The C-shaped element is also readily removable from the track member, as for example by sliding along the track member so that the visor may be replaced with a visor of a different color or shape. In some applications, it may also be possible to separate two articles by forcing the C-shaped element off of the I-shaped track member without movement therealong.

BRIEF DESCRIPTION OF THE DRAWINGS

The invention will now be described in connection with the accompanying drawings wherein like reference numerals have been used to indicate like parts.

FIG. 3 is a front view of a hat portion of the cap with the visor removed;

FIGS. 4-1, 4-2 is a front view of a pair of visors, each of which includes a C-shaped channel member or track stitched or stapled thereto;

FIG. 5 is a schematic illustration showing the visor of FIG. 4-1, 4-2 being attached to the hat portion of FIG. 3;

DETAILED DESCRIPTION OF THE PREFERRED EMBODIMENT OF THE INVENTION

Figure 1:
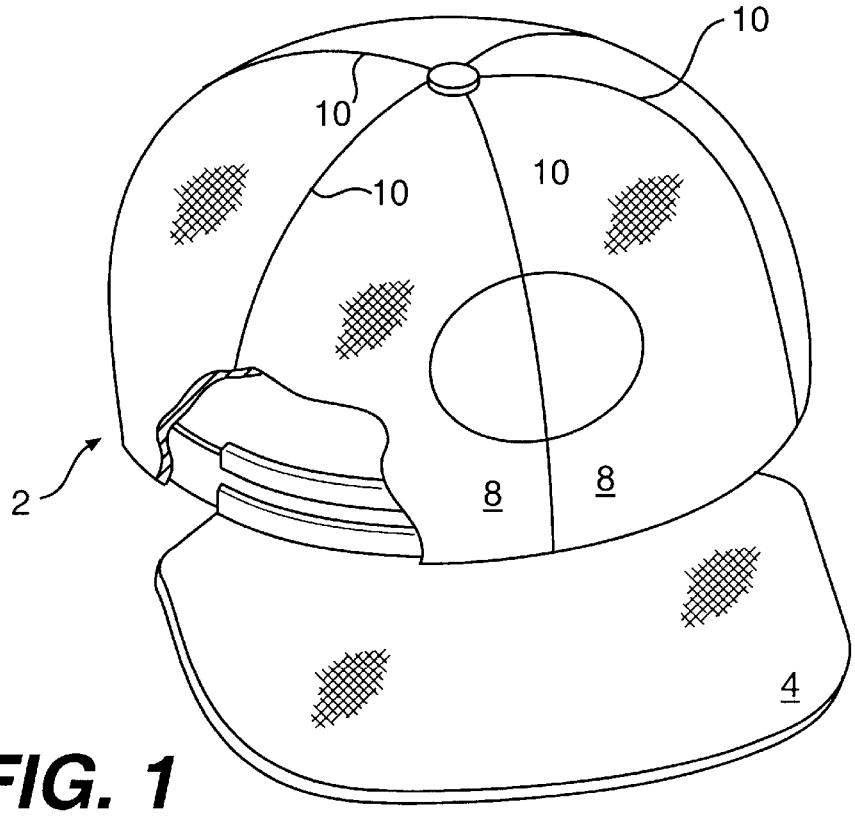
FIG. 1 is a perspective view of a sports cap in accordance with a first embodiment of the invention.

In a preferred embodiment of the invention a baseball cap 2 or the like has a removable and rotatable visor 4. The cap 2 includes a crown or hat portion 6 which is constructed from a plurality of pie-shaped segments or pieces of fabric 8 that are sewn together at a plurality of seams 10 in a customary manner. For example, the crown or hat portion may be constructed of six (6) pie-shaped segments joined together along seams 10. The seams 10 may include exposed threads (not shown) on either side of each seam and a button 11 at the top of the cap 2. The button 11 is sewn to the top of the cap 2 where the pie-shaped segments 8 meet together at their apexes.

The hat portion 6 may also be constructed by other techniques (such as molding) which will be well understood by those skilled in the art. Nevertheless, the hat portion 6 will preferably simulate the appearance of stitched pie-shaped elements.

The hat portion 6 also has a lower substantially circular periphery or base 12 which defines a band about the circumference of the hat portion 6. In one preferred embodiment of the invention the fabric at the base 12 of the cap 2 is folded under and upwardly upon itself to form a double thickness of material around the base 12. The double thickness of material is stitched around the circumference of the base to form a lower band therearound. The stitches may also include exposed threads of a contrasting color to create a pleasing visual effect. A second set of exposed stitches may also be used near the bottom of base 12 where the material is folded over.

The cap 2 also includes a semi-rigid elongated member 13 which is fixed to and extends or runs substantially around the periphery of the hat circumference or base 12. The elongated member 13 is preferably made of plastic or other suitable material and is preferably a relatively thin band of polypropylene, polyethylene or other suitable material, as will be well understood by those skilled in the art. In one embodiment of the invention, the thin band is extruded and has an I-shaped cross section having a height of about ¾ inch and a thickness of between about 1/64 and 1/16 of an inch. The elongated member 13 is then stitched to the interior surface of the band or base 12 about its circumference with the stitches passing through a central portion thereof.

The cap 2 also includes a relatively stiff visor 4 with a forward or bill portion 14 and an arc-shaped rear portion 16. The visor 4 is typically constructed of conventional materials. For example, the visor 4 may be made with a cardboard core (not shown) over which a cloth or fabric material is stitched or glued so that the visor 4 may be molded into a curved shape along its longitudinal axis. A second semi-rigid elongated member 18 is fixed to and generally conforms to the arc-shaped rear portion 16 of the visor 4. The second semi-rigid elongated member 18 is also extruded from the same material as the first elongated member 13, but has a C-shaped cross section. The dimensions of the second elongated member 18 are about ⅞ inch in height and about the same thickness as member 13. The second elongated member 18 is stitched to the arc-shaped portion 16 of the visor so that the arc-shaped portion 16 of the visor 4 and of the second semi-rigid member 18 are approximately equal. The second semi-rigid elongated member 18 which is now arc-shaped slidable extends upwardly from visor 4 and engages the first semi-rigid elongated member 13 which is also arc-shaped as it runs around the circumference of the base 12. Therefore, the second elongated member 18 is rotatable along the first elongated member 13 about the circumference of the hat portion 6 so that the visor 4 can be rotated around the hat portion 6. The second elongated member 18 is also readily removable from the first elongated member 13, so that the visor 4 may be replaced with a visor 4*a* of a different color or shape.

Figure 2:
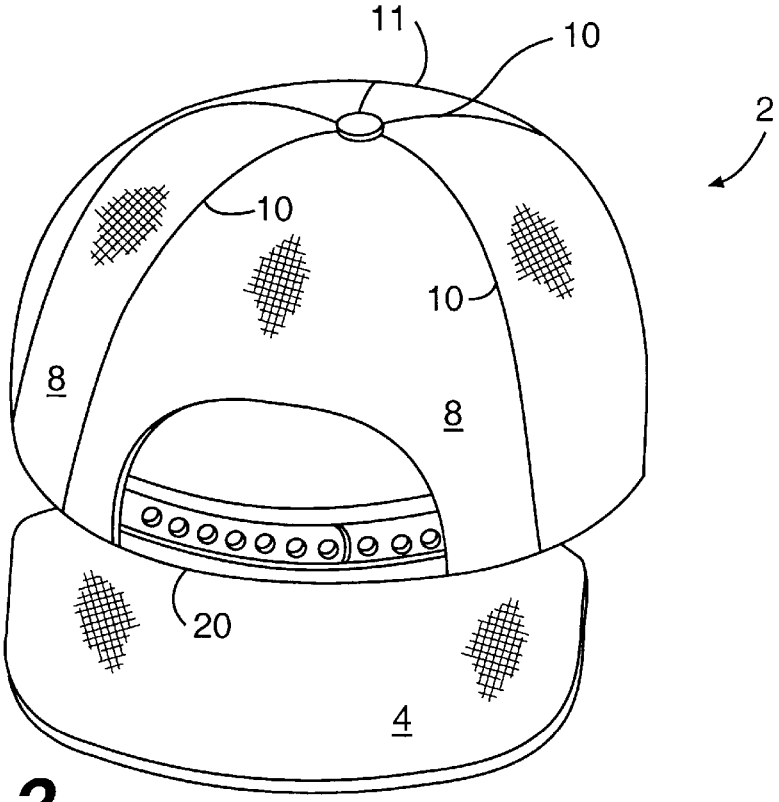
FIG. 2 is an elevational view of the cap shown in FIG. 1, but with the visor in a second position, i.e., at the back of the cap.

The ends of the first elongated member 13 overlap one another at the rear of the cap, as for example at the arcuate cut out 20 (FIG. 2). A first end includes a plurality of projecting members or fasteners while the second end includes a plurality of openings or holes of the type typically used for sizing a cap. In one embodiment of the invention, the first and second members 13 and 18 are sufficiently rigid and the dimensions sized so that the fit between the I-shaped elements and the C-shaped member are relatively tight. Also with proper size and fit, the visor will present a fair amount of resistance to movement and will stay in place in the selected position.

As illustrated in FIG. 5, the C-shaped member 18 is stitched to the arc-shaped rear portion 16 of the visor 4 and extends upwardly therefrom with the open portion of the C-shaped member facing toward the forward portion of the visor 4. In this, embodiment, the I-shaped member 13 is stitched through a middle portion thereof around the lower portion or base 12 of the hat portion 6.

In using a cap in accordance with the present invention, an individual can select the desired visor 4 or 4*a* (FIG. 3*b*), i.e., one of a selected color and shape and attach it to the crown in the following manner. For example, the I-shaped elongated member is stitched at the rear of the cap and the C-shaped elongated member is slid over the I-shaped element and slid around the cap to the front. The ends of the I-shaped member are then refastened in a customary manner and the cap is ready for use.

Figure 6:
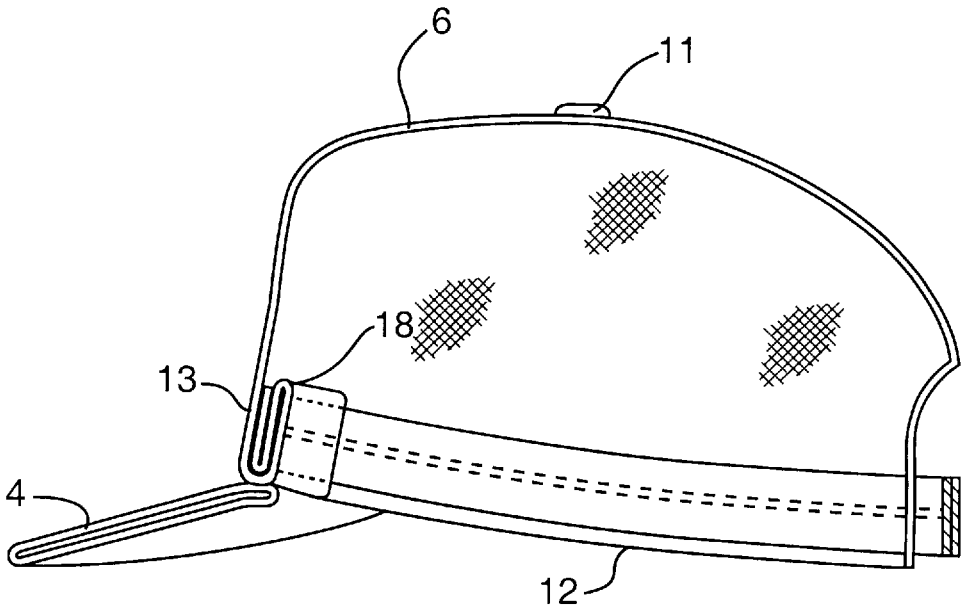
FIG. 6 is a cross-sectional view illustrating a C-shaped channel member or track and an I-shaped element stitched to the hat portion of the cap.
Figure 7:
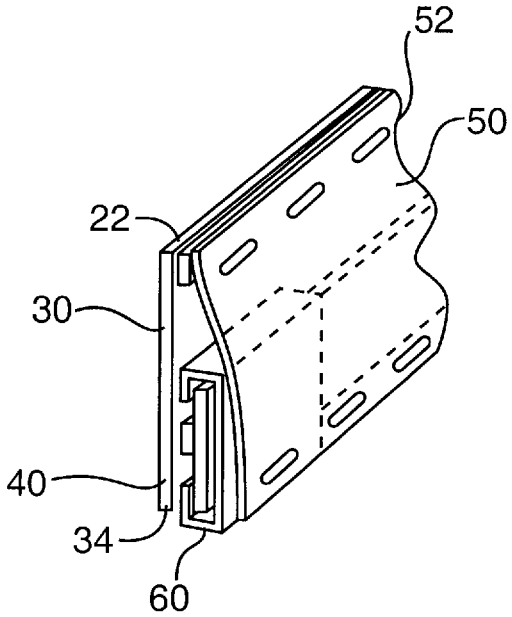
FIG. 7 is a perspective view showing a portion of a tracking assembly including any elongating track means and a sliding element position on the track means in accordance with a preferred embodiment of the inventions.
Figure 8:
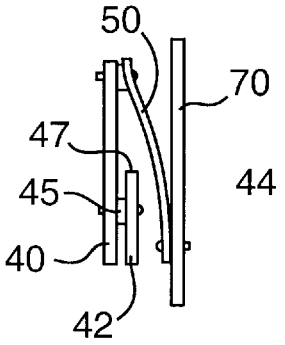
FIG. 8 is an end view of the tracking assembly shown in FIG. 7 with the sliding element removed and a sweat band for a sports cap or the like fixed to the tracking assembly.

As illustrated in FIGS. 6–8, a tracking assembly for a sports cap or the like, in accordance with a preferred embodiment of the invention, includes a first semi-rigid elongated plastic member 30 which has a pair of opposite edges 32 and 34 which form a top and bottom of the assembly as shown in FIGS. 6–8. The member 30 also includes an intermediate portion which is between the top and bottom edges 32 and 34. The first member 30 extends along and is fixed to a first article (not shown) such as the hat portion of a sports cap.

A second generally I-shaped elongated plastic track member 40 has a pair of opposed edges 41 and 42 and a central area 44. The second generally I-shaped elongated plastic track member 40 extends along and is fixed to the first semi-rigid plastic member 30 through its central area 44 and through an intermediate portion of member 30 by fasting means such as stitches 45.

A third elongated plastic member 50 is fixed along one edge or side thereof to the first elongated member along the edge 32 thereof. The third elongated member 50 extends over the second generally I-shaped elongated track member 40 in a generally superposed position with the opposite edges forming an opening therebetween.

Figure 9:
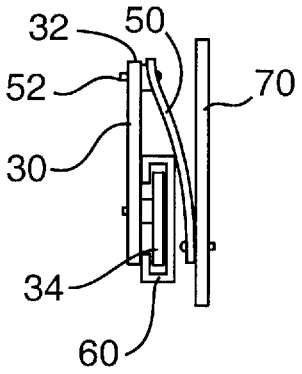
FIG. 9 is an end view of the tracking assembly shown in FIG. 8 with the sliding element position on the track means; and, FIG. 10 is a schematic illustration of a cap visor with a pair of sliding elements affixed thereto.
Figure 10:
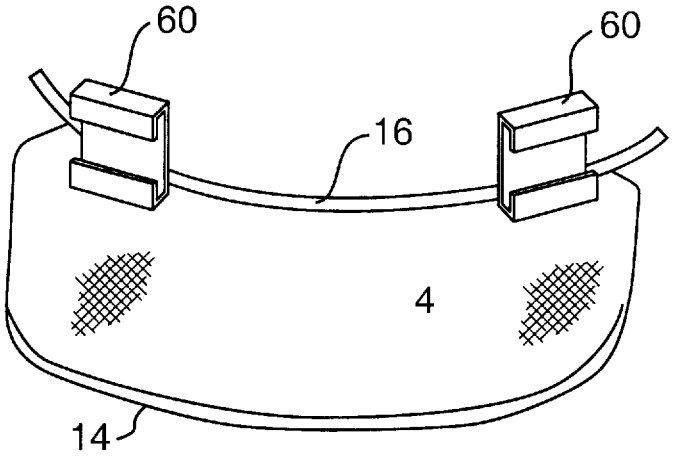

A C-shaped plastic element 60 is attached to a second article such as a visor 4 of a sports cap or the like as shown in FIG. 9. The C-shaped plastic element 60 may also comprise an elongated element which extends along a rear arc of the visor 4. The C-shaped element is constructed and arranged to fit over the I-shaped track member in sliding engagement therewith to thereby fasten the first and second articles together. In those applications such as a sporting cap, it is important that the C-shaped element does not bind with the cloth fabric of the hat. This is particularly important in those caps which include a sweat band 70. In such cases the elongated members 30 and 50 allow the C-shaped element to move smoothly around the periphery of the cap.

While the invention has been described in connection with its preferred embodiments, it should be recognized that changes and modifications may be made without departing from the scope of the appended claims.

I claim:

1. A sports cap having a rotatable and removable visor comprising:

a crown having a lower substantially circular periphery defining a hat circumference;

a substantially stiff visor having a forward or bill portion and an arc-shaped rear portion;

releasable holding means for releasible holding said visor in sliding engagement with said crown so that the visor can be rotated about said crown or removed therefrom;

said releasable holding means including a first semi-rigid elongated member having a pair of opposed edges and an intermediate portion connecting said opposed edges extending around and fixed to said lower substantially circular periphery of the hat, a second generally I-shaped elongated plastic track member having top and bottom edges and a central area connecting said top and bottom edges, said second I-shaped elongated plastic track member superposed on said semi-rigid elongated member and fixed thereto through the central area thereof;

a C-shaped plastic element attached to said visor and fitting over said I-shaped track member in sliding engagement therewith to thereby provide a slidable track assembly for joining the crown and visor together while allowing rotation therebetween and wherein said crown and visor may be separated without rotating the C-shaped element along the I-shaped track member; and a third elongated member fixed to said first elongated member and extending over said second generally I-shaped elongated track member.

2. A sports cap having a rotatable and removable visor according to claim 1, which includes a sweat band attached to said third elongated member.

3. A sports cap having a rotatable and removable visor comprising:

a hat portion constructed of a plurality of pie-shaped portions of fabric sewn together at a plurality of seams, said hat portion having a lower substantially circular periphery defining a hat circumference;

a first semi-rigid longitudinally extending plastic member having top and bottom edges and an intermediate portion therebetween fixed to and extending substantially around the periphery of the hat circumference;

a second generally I-shaped elongated plastic track member having top and bottom edges and a central area, said second I-shaped elongated member extending along and fixed to said first semi-rigid plastic member through said central area and said intermediate portion;

a third elongated plastic member having first and second edges, said third member being fixed to said first elongated plastic member along said first edge thereof and extending over said second generally I-shaped elongated track member in a generally superposed position with the bottom edge of said first elongated plastic member and the second edge of said third member forming an opening therebetween;

a first relatively stiff visor having a forward or bill portion and an arc shaped rear portion;

a C-shaped plastic element attached to said first relatively stiff visor and said C-shaped plastic element fitting over said I-shaped track member in sliding engagement therewith to thereby provide a slidable track assembly for joining said hat portion and said visor together;

wherein said third elongated member allows said C-shaped element to move along said I-shaped elongated track member without binding on said hat portion; and, wherein said hat portion and said visor may be separated by forcing said C-shaped element off of said I-shaped track member without movement therealong.

4. A sports cap having a rotatable and removable visor according to claim 3 which includes a second relatively stiff visor having a forward or bill portion and an arc shaped rear portion and a second C-shaped plastic element attached to said second visor so that said first visor can be readily removed from said hat portion and replaced with said second visor.

5. A sports cap having a rotatable and removable visor according to claim 4 which includes a sweat band attached to said third elongated member.

6. A flexible tracking assembly for interconnecting two adjacent articles comprising:

first and second adjacent articles;

a first semi-rigid elongated plastic member having top and bottom edges and an intermediate portion connecting said top and bottom edges, said semi-rigid elongated plastic member extending along and fixed to a first of said articles;

a second generally I-shaped elongated plastic track member having top and bottom edges and a central area, said second generally I-shaped elongated plastic member extending along and fixed to said first semi-rigid plastic member through said central area and said intermediate portion;

a third elongated plastic member having first and second edges, said third member being fixed along said first edge to said first elongated member and extending over said second generally I-shaped elongated track member in a generally superposed position, with the bottom edge of said first elongated plastic member and the second edge of said third elongated plastic member forming an opening therebetween;

a C-shaped plastic element attached to said second of said articles and adapted to fit over said I-shaped member in sliding engagement therewith to thereby provide a slidable track assembly for joining the first and second articles together;

wherein said third elongated member allows said C-shaped element to move along said I-shaped elongated track member without binding on said first and second articles.

7. A flexible tracking assembly according to claim 6 wherein said first and second articles may be separated by forcing said C-shaped element off of said I-shaped track member without movement there along.

* * * * *